US006130952A

United States Patent [19]

Akino et al.

[11] Patent Number: 6,130,952

[45] Date of Patent: Oct. 10, 2000

[54] MICROPHONE

[75] Inventors: Hiroshi Akino, Sagamihara, Japan; Bob Green, Akron, Ohio; Shioto Okita, Kawasaki, Japan; Kazuhisa Kondo, Yamato, Japan; Shigeru Uzawa, Tokyo, Japan

[73] Assignee: Kabushiki Kaisha Audio-Technica, Tokyo, Japan

[21] Appl. No.: 08/950,881

[22] Filed: Oct. 15, 1997

[30] Foreign Application Priority Data

Nov. 8, 1996 [JP] Japan ..... 8-312788

[51] Int. Cl.[7] ..... H04R 25/00

[52] U.S. Cl. ..... 381/368; 381/360; 381/361; 381/398

[58] Field of Search ..... 381/361, 368, 381/398, 177, 174, 353, 354, 344, FOR 147, FOR 148, FOR 153

[56] References Cited

U.S. PATENT DOCUMENTS 5,673,330 9/1997 Chang ..... 381/398

*Primary Examiner*—Huyen Le
*Attorney, Agent, or Firm*—Welsh & Katz, Ltd.

[57] ABSTRACT

A microphone in which a diaphragm which is vibrated by a sound wave received, and a conversion portion such as a magnetic circuit for electrically acting on the diaphragm to convert the vibration into an electric signal are incorporated into a unit case, wherein a first elastic body and a second elastic body are arranged on the upper surface and the lower surface, respectively, of an peripheral edge portion of the diaphragm, the diaphragm is mounted on the unit case through the first elastic body on the upper surface of the peripheral edge portion thereof, and one end side of the conversion portion is placed in contact with the second elastic body arranged on the lower surface of the peripheral edge portion of diaphragm to encase the conversion portion into the unit case.

8 Claims, 6 Drawing Sheets

MICROPHONE

FIELD OF THE INVENTION

The present invention relates to a microphone provided with a vibrational noise reducing means.

DESCRIPTION OF PRIOR ART

In a microphone, particularly, a portable microphone, the vibrational noise generated by vibrations propagated from a unit case of a microphone often poses a problem. The noise is generated because, when the unit case of a microphone is displaced in a certain direction, mass of a vibrating system including a diaphragm tends to stop at an original position.

In the microphone, a microphone unit is stored in a unit case. The microphone unit is roughly divided into a vibration portion and a conversion portion (a fixed portion) which electrically acts on the vibration portion to convert the vibration into an electrical signal. The output of an electrical signal caused by the sound wave of the microphone relies on the relative displacement or relative speed of the vibration portion and the conversion portion. The relative displacement or relative speed of the vibration portion and the conversion portion are generated not only by the sound wave but also by the vibrations propagated from the unit case.

A typical microphone for obtaining a signal output by the relative displacement is a condenser type microphone. On the other hand, a typical microphone for obtaining a signal output by the relative speed is a dynamic type microphone. Incidentally, the vibrational noise rely on the mass for setting a resonance frequency of a vibration system and its elasticity. From a viewpoint of control systems of the microphone, the mass of the vibration portion is in the relationship of mass control>resistance control>elasticity control.

Therefore, the magnitude of vibrational noise is generally in order of double directivity ribbon (or dynamic) microphone>non-directivity dynamic microphone>non-directivity condenser microphone. Out of portable microphone, in a single directivity dynamic microphone, particularly, the vibrational noise poses a problem as a handling noise.

The handling noises include the vibrational noise of a low frequency component like a sound "pon-pon" generated when the microphone moves so as to pat the thumb of the hand which holes the microphone, and the vibrational noise of a relatively high frequency component like a sound "kasa-kasa" generated when the thumb rubs on the microphone. The noise of the low frequency component has the directivity of cos θ with respect to the vibration axis of the diaphragm, but the noise of the high frequency component has not specific directivity since it is generated by the solid propagation of the channel consisting of unit case→elastic support material→microphone unit.

Means for reducing (preventing) the vibrational noise so far known include a method for mechanically isolating vibrations by the shock mount, and a method for offsetting the vibrational noise by mounting a unit for detecting the vibrational noise in addition to a normal microphone unit.

First, the former shock mount method will be explained. This is a method for isolating vibrations of the microphone unit using a viscoelastic body as gum when the microphone unit is mounted on the unit case, for example, as shown in Japanese Patent Laid-Open No. 1-197000.

On the other hand, in the latter method for offsetting the vibrational noise, for example, as shown in U.S. Pat. No. 2,835,735, there is used, for a displacement proportional type microphone unit, a displacement proportional type vibration detection unit is likewise used, and in the case of a speed proportional type microphone unit, a speed proportional type vibration detection unit is likewise used, whereby signal outputs of both the units are subtracted to reduce the vibrational noise.

The vibration isolation effect in the former shock mount method relies on the resonance frequency and the resonance sharpness of the vibration system, and the resonance frequency is lowered whereby the frequency band having the vibration isolation effect can be widened.

However, when the resonance frequency is lowered, even in the steady state, the microphone unit is displaced from the normal position due to the gravity. If the strong shock is applied to the unit case from outside, the displacement of the microphone becomes extremely large, and the microphone unit collides with the unit case to sometimes generate a big shock sound.

With respect to the resonance sharpness, the higher the resonance sharpness, the larger the vibration isolation effect at the high frequency. However, the vibrational noise at the resonance frequency becomes increased as compared with the case without support of vibration isolation. From the foregoing, when the resonance frequency is lowered or the resonance sharpness is increased, immoderately, the practical trouble is brought forth.

Further, out of the handling noises, the relatively high frequency components generated when the thumb rubs on the unit case relies on the solid propagation as previously mentioned. Therefore, in the case where the sectional area of the shock mount is large, it is not possible to prevent the vibrational noise in the high band.

According to the latter method for offsetting the vibrational noise, signal output levels and phases of the normal microphone unit and the vibration detection unit are adjusted and subtracted whereby the vibrational noise can be reduced extremely satisfactorily. In practice, however, it is difficult to make the signal outputs of both the units the same in the wide frequency band.

That is, even if the microphone unit has the same construction as that of the vibration detection unit, in the diaphragm of the microphone unit, air normally called the additive mass which vibrates the same as the diaphragm is present. On the other hand, the vibration detection unit is surrounded by a cylinder member so as to prevent the sound wave from entering. Even if the cylinder member is vibrated by the sound wave, the diaphragm of the vibration detection unit is to operate in a manner such that the mass equivalently decreases.

Thereby, in the vibration detection unit, the resonance frequency of the diaphragm rises and the signal output level lowers, and a phase difference occurs in the signal output of the microphone unit. In consideration of the above point, in the aforesaid U.S. Pat. No. 2,835,735, the frequency to be cancelled is limited to a low sound band, and in the frequency band in excess of a middle sound band, the shock mount is used to reduce the vibrational noise.

However, naturally, it is necessary that the adjustment of the signal levels output from both the units and the phases thereof are still done very minutely. Further, it cannot be denied that the balance is lost for some factor (for example, a rise in temperature), in which case, the vibrational noise is likely increased. Further, since fundamentally, the vibration detection unit is required in addition to the microphone unit, it cannot be denied that the cost is high, the weight increases, and the device becomes large in size.

In Japanese Patent No. 57-9279 as a separate prior art, as shown in FIG. 8, in housing a diaphragm 2 and a magnetic circuit portion 3 as a conversion portion in a unit case 1 of a microphone, the magnetic circuit portion 3 side is supported on the unit case 1 through an elastic element 4 such as rubber.

That is, the diaphragm 2 and the magnetic circuit portion 3 are vibrated in the same direction with respect to the vibration of the unit case 1 to thereby not to generate a relative speed between the diaphragm 2 and the magnetic circuit portion 3. Since with respect to the sound wave, the mass of the magnetic circuit portion 3 is extremely large relative to the mass of the vibration plat 2, the magnetic circuit portion 3 is not vibrated by the sound wave but only the diaphragm 2 is vibrated. Therefore, the relative speed occurs therebetween and the signal output is obtained by the voice.

In this method, it is required that the resonance frequency of the diaphragm 2 is made the same as that of the magnetic circuit portion 3 elastically supported. However, the method is fundamentally not a method for offsetting signal outputs of both the units as in the aforementioned prior art. Therefore, the adjustment of the signal level or phase is not necessary, and the reduction in vibrational noise in the wide range of frequency can be made.

However, since the end of the diaphragm 2 is still directly secured to the unit case 1, the relative speed occurs between the diaphragm 2 and the magnetic circuit portion 3 by the vibrational noise solid-propagated from the unit case 1. It is difficult to reduce the handling noise such as "kasa-kasa" due to the particularly high frequency component.

SUMMARY OF THE INVENTION

An object of the present invention is to provide a microphone which is simple in constitution provided with a means for reducing the vibrational noise capable of reducing the vibrational noise in a wide frequency range.

The microphone according to the present invention comprises a diaphragm which is vibrated by a sound wave received, a conversion portion for electrically acting on said diaphragm to convert the vibration into an electric signal, and a first elastic body and a second elastic body arranged on the upper surface and the lower surface of an peripheral edge portion of said diaphragm, said diaphragm being mounted on the upper surface of the peripheral edge portion through said first elastic body, and said conversion portion having one end side placed in contact with said second elastic body arranged on the lower surface of the peripheral edge portion to house said conversion portion into a unit case.

With the constitution as described above, the vibration speed applied to the unit case is transmitted to the second elastic body on the lower surface of the peripheral edge portion of the diaphragm through the first elastic body on the upper surface of the peripheral edge portion of the diaphragm and applied to the conversion portion (the magnetic circuit portion). By limiting a channel in which the vibration speed is solid-propagated, it is possible to reduce the vibrational noise which is generated when the unit case is rubbed.

In this case, preferably, the first and second elastic bodies are in the form of a ring of substantially the same diameter, and projections are formed at least on one surface at predetermined intervals. According to this, since the solid propagation channel of the vibration speed is further limited, the effect of reducing the vibrational noise is further enhanced.

The stiffness of the first and second elastic bodies is set corresponding to the ratio between the mass of a diaphragm and mass of a converter. Thereby, the vibration speed from the unit case is divided according to the stiffness of each elastic body, and the vibration speed applied to the diaphragm is substantially the same as that applied to the conversion portion to suppress the relative speed displacement.

Further, preferably, the other end of the conversion portion is supported on the unit case through a third elastic body. The third elastic body is provided to apply a bias to the first and second elastic bodies, and by suitably setting a mechanical impedance, a phase difference of vibration characteristics of the diaphragm and the conversion portion in a high region caused by the acoustic impedance is reduced. It is necessary to set the stiffness of the third elastic body smaller than the stiffnesses of the first and second elastic bodies.

The present invention can be applied to the single directivity dynamic microphone as well as an electrostatic capacity microphone.

The microphone according to the present invention has the following effects.

The relative vibration speed and the relative vibration displacement on the diaphragm side and the converter side are made substantially the same with respect to the vibrations solid-propagated from the unit case, whereby the vibrational noise can be reduced satisfactorily.

The vibration detection unit and an electric circuit incidental thereto as in the signal output offsetting method are not necessary. A few elastic bodies as constituent parts will suffice to be added to a normal microphone unit, thus providing a microphone at less cost.

Being the construction for reducing the vibrational noise including the acoustic circuit, it is possible to effectively reduce the vibrational noise in the wide frequency range. Further, the vibration speed is divided by the end of the diaphragm whereby the vibrational noise caused by the solid propagation can be reduced.

DESCRIPTION OF THE PREFERRED EMBODIMENTS

Figure 1:
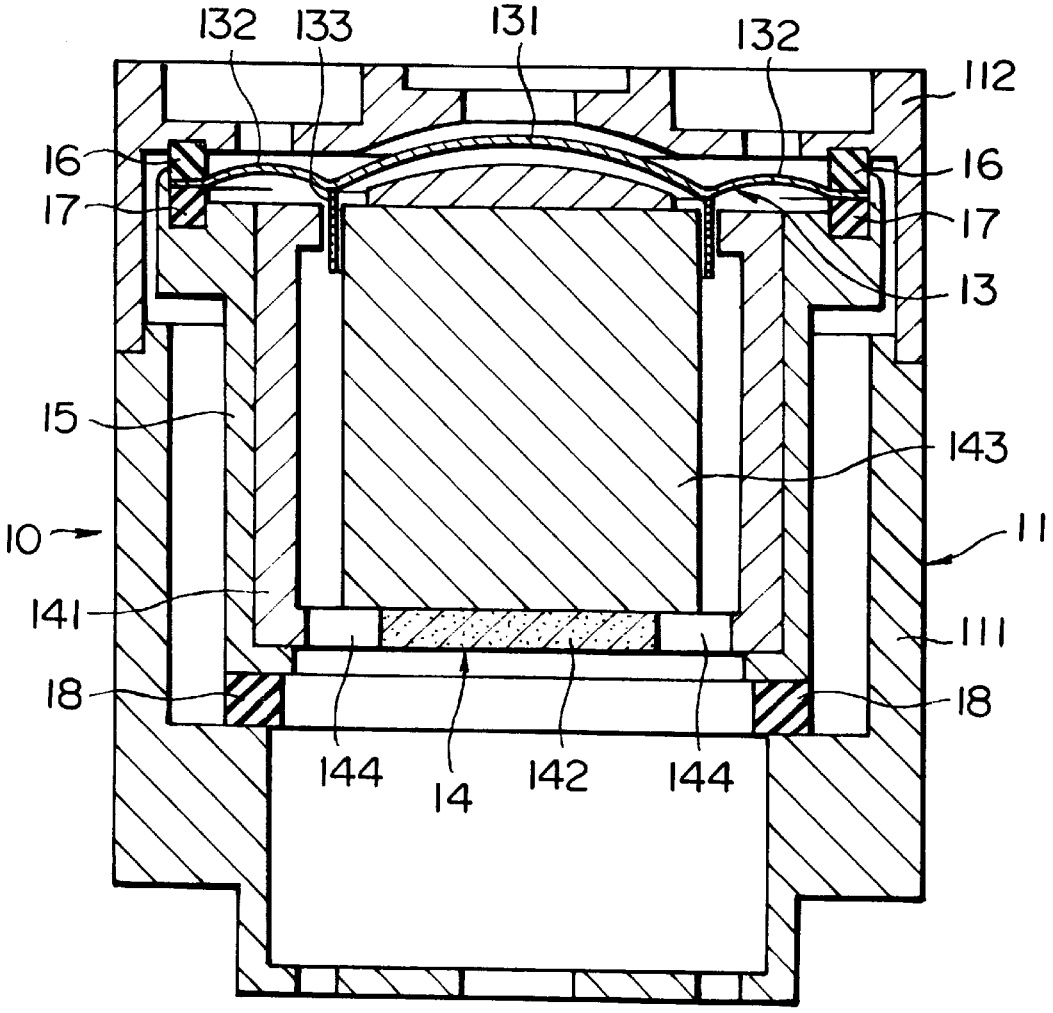
FIG. 1 is a sectional view of a first embodiment of a single directivity dynamic microphone according to the present invention.

The embodiments of the present invention will be described hereinafter with reference to the accompanying drawings. FIG. 1 shows a first embodiment of a single directivity dynamic microphone according to the present invention. The microphone 10 comprises a unit case 11 made of metal. In this case, the unit case 11 comprises a substantially cylindrical case body 111, and an acoustic resonator 112 connected to an opening on the front side of the case body 111, for example, by threading.

Within the unit case 11 are encased a diaphragm 13 and a conversion portion 14 for electrically acting on the diaphragm 13 to convert the vibration into an electric signal. The diaphragm 13 comprises a diaphragm including a center dome portion 131 and an edge portion 132 provided on the peripheral edge thereof, and a voice coil 133 is secured to the back of the peripheral edge of the center dome 131.

The conversion portion 14 has a cylindrical yoke portion 141, a magnet 142 arranged on the bottom, and a pole piece 143 provided on the magnet 142 to form a magnetic gap relative to the voice coil 133 between an opening in the upper end of the yoke portion 141 and the pole piece 143. That is, the conversion portion 14 comprises a magnetic gap with respect to the diaphragm 13. In this embodiment, a rear acoustic terminal 144 is provided on the bottom surface side of the yoke portion 141, and the conversion portion 14 is totally held within a holder 15, the conversion portion 14 being encased into the unit case 11 through the holder 15.

In encasing the diaphragm 13 and the conversion portion 14 as the magnetic circuit portion into the unit case 11, the present invention provides the following means in order that both, that is, the diaphragm 13 and the conversion portion 14 are in the same vibration speed with respect to the vibrations applied from the unit case 11.

A first elastic body 16 and a second elastic body 17 are arranged on an upper surface and a lower surface, respectively, of a peripheral edge portion (more specifically, a peripheral edge portion of an edge portion 132) of the diaphragm 13, and the diaphragm 13 is mounted on the unit case 11 (on the side of the acoustic resonator 112 in this embodiment) through the first elastic body 16 on the upper surface side of the peripheral edge portion thereof.

In the conversion portion 14, its upper end side is placed in contact with the second elastic body 17 arranged on the lower surface side of the peripheral edge portion of the diaphragm 13 to encase the conversion portion 14 into the unit case 11, and a third elastic body 18 is arranged on the rear end side of the conversion portion 14 and is elastically supported on the unit case 11.

Figure 2:
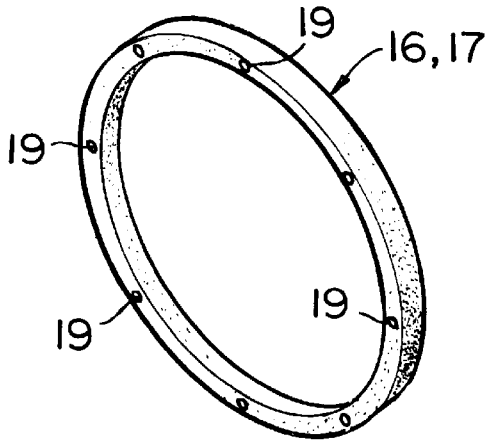
FIG. 2 is a perspective view of a first and a second elastic body of the first embodiment according to the present invention.

The first and second elastic bodies 16, 17 may be formed of a visco-elastic material such as rubber used as a normal damper material, and a ring-like elastic body as shown in FIG. 2 is used. Both the elastic bodies 16, 17 have the same diameter. It is preferable to provide projections 19 at predetermined intervals at least on the surface in contact with the peripheral edge portion of the diaphragm 13 in limiting the propagation channel of the vibration speed. It is of course that the projections 19 may be formed on both sides of the ring surface.

The stiffness of the first elastic body 16 and the second elastic body will be explained. In the case of the dynamic microphone in this embodiment, main mass of the diaphragm 13 is that in the voice coil 133, its weight is generally scores mg, and the resonance frequency of the diaphragm 13 is set by the low region reproduction limit required by the microphone. On the other hand, the weight of the conversion portion (magnetic circuit portion) 14 is generally a few g to scores g, and the resonance frequency is set by the stiffness of the elastic body supporting it.

As described above, the mass of the diaphragm 13 and the mass of the conversion portion 14 are different in 100 to 1000 times. A vibromotive force source F with respect to the mass M relative to the vibration speed Vo of the unit case 11 is expressed by $$F=j\omega VoM \text{ (where } \omega=2\pi f),$$

which is proportional to the magnitude of the mass M.

In the present invention, the stiffnesses of the first elastic body 16 and the second elastic body 17 are set, so that the resonance frequency of the vibration system of the diaphragm 13 is substantially equal to that of the conversion portion 14, according to the ratio between these masses. According to this, the vibration speed solid-propagated from the unit case 11 is divided according to the stiffnesses of the first and second elastic bodies 16, 17 and then applied to the vibration system of the diaphragm 13 and the vibration system of the conversion portion 14, and therefore, the difference in vibration speed between both the vibration systems due to the difference of the vibromotive force source can be reduced.

The third elastic body 18 intervened between the rear end portion of the conversion portion 14 and the unit case 11 may be formed of a rubber material or formed from a plate spring. In any way, its stiffness is set to be smaller than the stiffnesses of the first and second elastic bodies 16, 17. The difference in the vibromotive force source between both the vibration systems can be finely adjusted by the mechanical impedance of the third elastic body 18.

Figure 3:
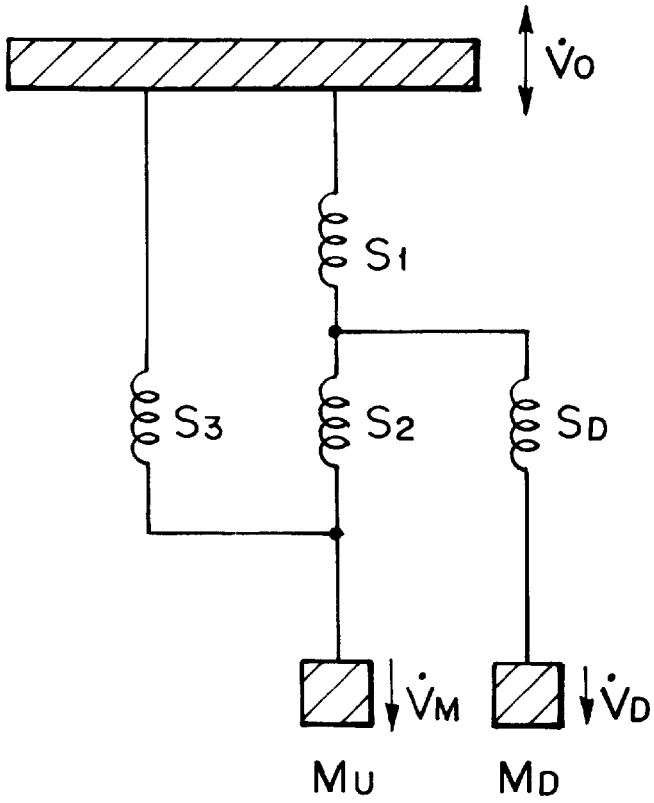
FIG. 3 is a conceptual view of a mechanical vibration system of the first embodiment according to the present invention.
Figure 4:
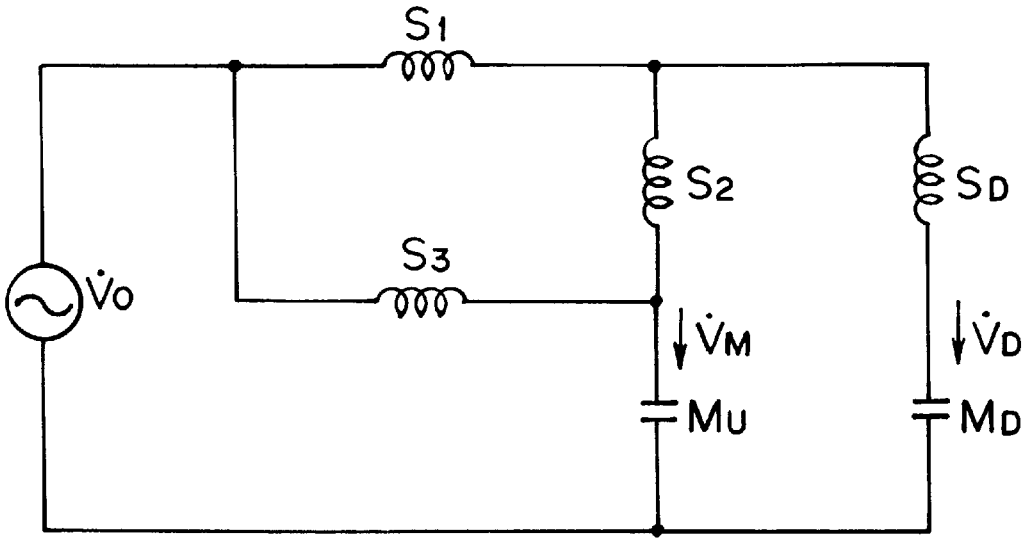
FIG. 4 shows an equivalent circuit of a mechanical vibration system of the first embodiment according to the present invention.

FIG. 3 is a conceptual view of a mechanical vibration system of the microphone unit, and FIG. 4 shows an equivalent circuit of the mechanical vibration system. In these drawings, Vo (vector display) designates the vibration speed solid-propagated from the unit case 11; S1, S2, S3 designate the stiffnesses of the first, second and third elastic bodies 16, 17, 18, respectively; SD designates the stiffness of the vibration plate 13; MU, MD designate the masses of the conversion portion 14 and the vibration plate 13, respectively; and VM, VD designate the vibration speeds of the conversion portion 14 and the diaphragm 13, respectively, from which will be understood that the vibration speed Vo solid-propagated from the unit case 11 is divided according to the stiffnesses S1, S2 of the first and second elastic bodies 16, 17 and then applied to the diaphragm 13 and the conversion portion 14.

Figure 5A:
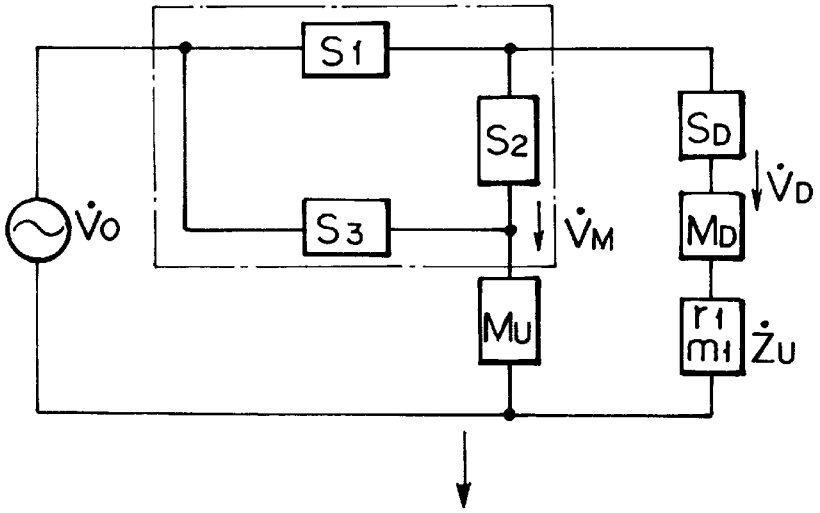
FIG. 5 shows a simple equivalent circuit of a mechanical vibration system of the first embodiment according to the present invention.
Figure 5B:
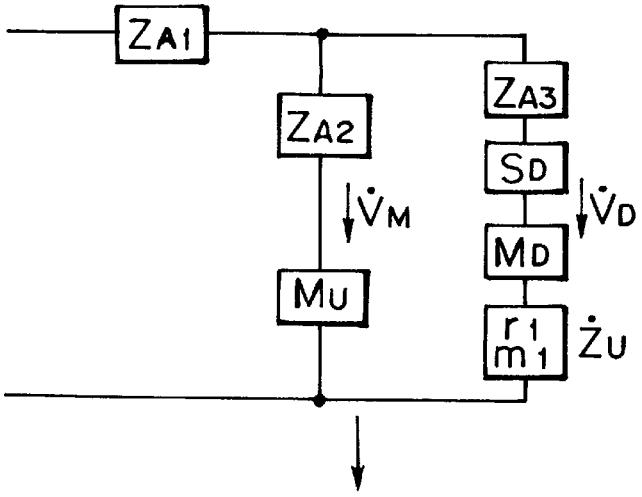
Figure 5C:
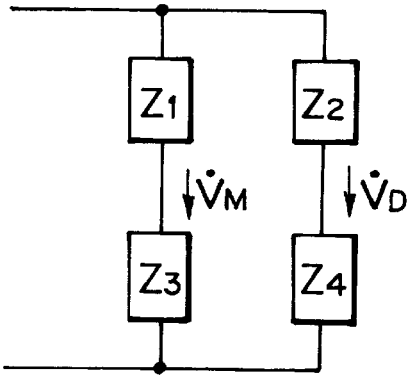

For reference, FIG. 5 shows a simple equivalent circuit taking the impedance of the acoustic system into consideration, in the mechanical vibration system shown in FIG. 3. FIG. 5A shows a fundamental equivalent circuit. ZU (vector display) designates the acoustic impedance of the diaphragm 13; r1 designates the acoustic resistance from the rear portion of the diaphragm to the rear air chamber; and m1 designates the acoustic mass from the rear acoustic terminal. It is considered that the fundamental equivalent circuit is finally simplified as shown in FIG. 5C through FIG. 5B into a normal AC bridge.

Elastic bodies having the resistivity formed of a visco-elastic material, for example, such as soft rubber are set to the stiffnesses S1, S2, S3 so as to fulfill the balance conditions of the bridge whereby all the vibration system including the impedance of the acoustic system can be balanced. Accordingly, the vibrational noises in the wide frequency band can be reduced in a stable manner.

Figure 6:
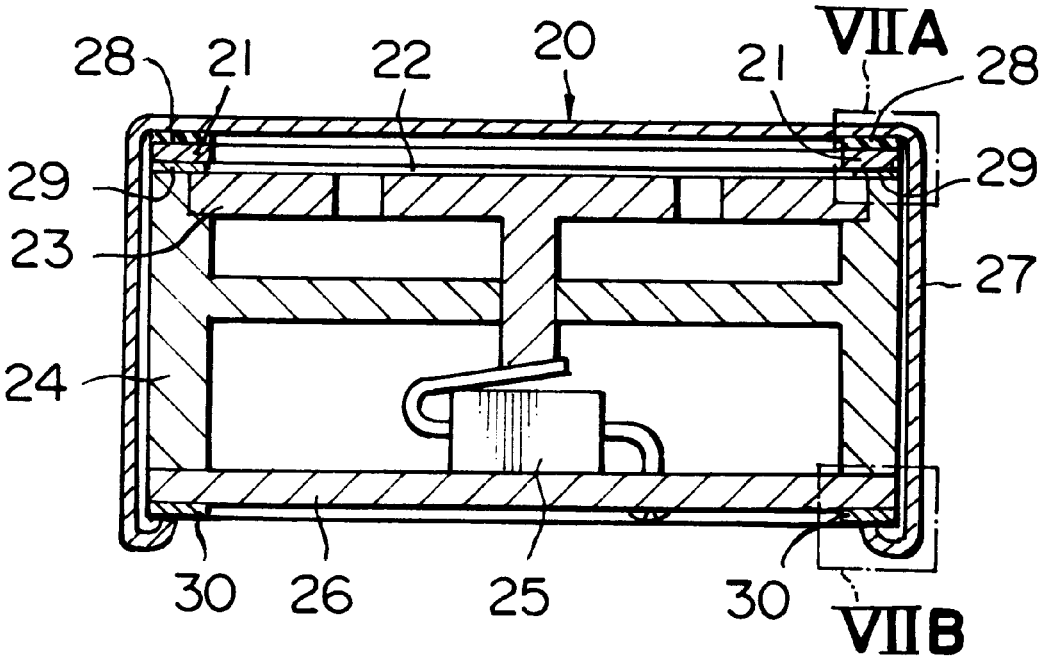
FIG. 6 is a sectional view of a second embodiment of a condenser microphone according to the present invention.
Figure 7A:
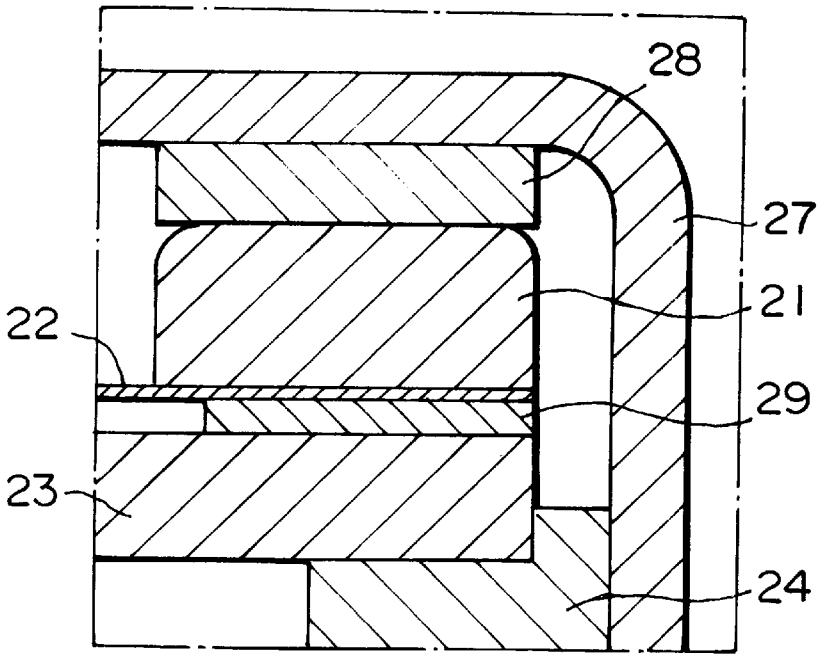
FIGS. 7A and 7B are enlarged sectional views of VIIA portion and VIIB portion of FIG. 6.

The second embodiment in which the present invention is applied to the condenser microphone will be explained hereinafter with reference to FIGS. 6 and 7. FIG. 6 is a schematic sectional view of a condenser microphone 20, which comprises a diaphragm 22 extended over a holding ring 21, and a fixed pole 23 arranged opposite to the diaphragm 22 through a predetermined gap.

The fixed pole 23 is supported on the upper end side of an electrically insulated support body 24, and a circuit substrate 26 having an impedance converter 25 electrically connected to the fixed pole 23 is mounted on the lower end side of the support body 24.

The fixed pole 23 supported on the support body 24 is encased as the converter with respect to the diaphragm 22 into a unit case 27 at predetermined intervals together with the diaphragm 22, and is integrally assembled within the unit case 27 by caulking the open edge portion in the lower end side of the unit case 27.

The diaphragm 22 is encased in the unit case 27 through the holding ring 21. In this case, however, as shown in the detailed sectional view of FIG. 7A, a first elastic body 28 and a second elastic body 29 are arranged on the upper surface and lower surface, respectively, of the holding ring 21. That is, the holding ring 21 of the diaphragm 22 is placed in contact with the unit case 27 through the first elastic body 28 on the upper surface side, and the second elastic body 29 on the lower surface side also serves as a spacer between it and the fixed pole 23.

Also, in this embodiment, the stiffnesses of the first and second elastic bodies 27, 28 are set corresponding to the mass of the diaphragm 22 including the holding ring 21 and the mass of the fixed pole 23 including the support body 24, similar to the dynamic microphone 10.

Figure 7B:
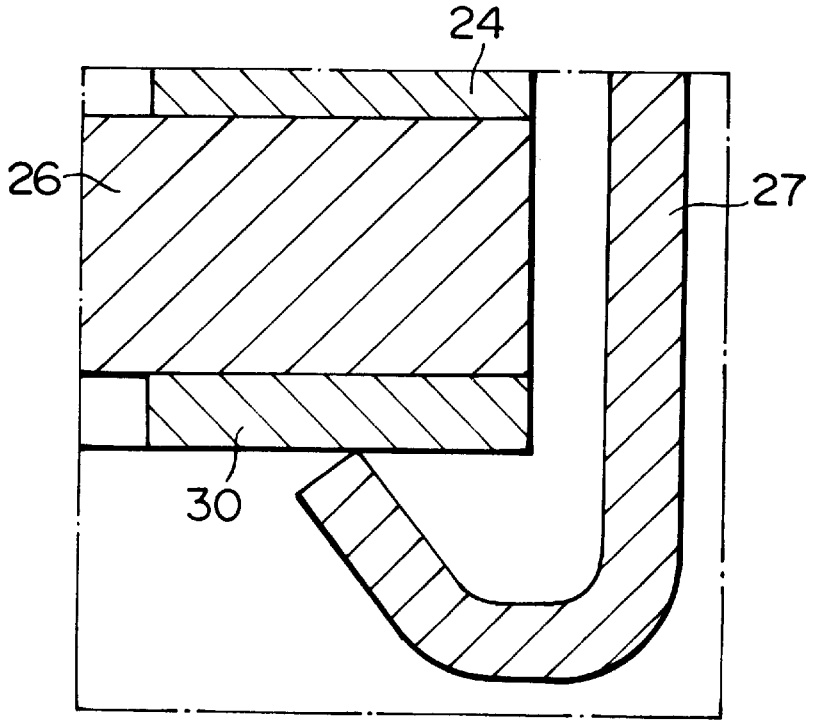
Figure 8:
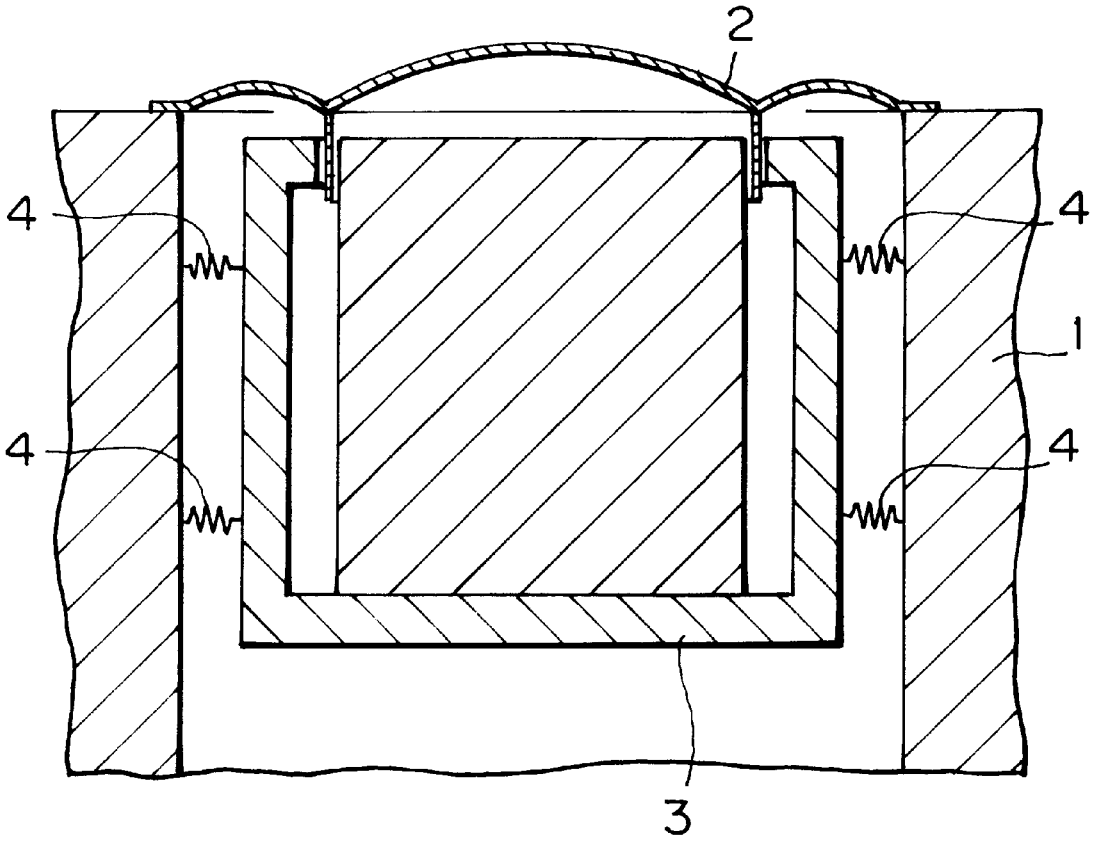
FIG. 8 PRIOR ART
FIG. 8 is a schematic sectional views showing a conventional example of means for reducing vibrational noises in a microphone.

As shown in the detailed sectional view of FIG. 7B, in caulking the open edge portion in the lower end side of the unit case 27, an elastic body 30 is intervened between the open edge portion and the circuit substrate 26. The stiffness of the third elastic body 30 is set to a smaller value than the first and second elastic bodies 28, 29, similar to the dynamic microphone 10.

According to the aforementioned constitution, the vibration speed as the noise component propagated through the unit case 17 is divided according to the stiffnesses of the first and second elastic bodies 27, 28 and divided into the vibration system including the diaphragm 22 and the vibration system of the support body 24 including the fixed pole 23 and then transmitted, similar to the case of the above-described dynamic microphone 10. Thus, the vibrational noise can be reduced similar to the embodiment of the dynamic microphone 10 as described above.

What is claimed is:

1. A dynamic microphone including a tubular unit case having an opening for entry of sound waves; a diaphragm covering said opening, said diaphragm having the shape of a dome, a ring surrounding the dome, said diaphragm vibrating by the acoustic energy of sound and having a voice coil located at a connection of said dome with said ring; and an acoustic transducer unit in said tubular unit case; said microphone further including said tubular unit case and having a resonator and a case body, said resonator having a front face and a back face, the back face having an edge portion extending rearwardly therefrom, said case body having a front face for coupling with the edge portion of the back face of the resonator, said acoustic transducer unit including a cylindrical pole piece, a magnet disposed on the bottom portion of said pole piece, and a cylindrical yoke portion disposed around the magnet and the pole piece; a tubular holder having a bottom face and a back face, the tubular holder having an inner edge formed about the periphery of the bottom face thereof for holding a back face of the yoke portion of said acoustic transducer unit, said tubular holder being accommodated in said case body of the tubular unit case;

a first elastic member disposed between the front face edge of said diaphragm and the back face edge of said resonator of the tubular unit case;

a second elastic member disposed between the back face edge of said diaphragm and a front face edge of said tubular holder; and a third elastic member disposed between the back face edge of said holder for holding said acoustic transducer unit and the bottom edge of the case body of said tubular unit case.

2. The dynamic microphone of claim 1, wherein said first elastic member or said second elastic member has a plurality of protrusions arranged on at least one of the upper and lower surfaces thereof at predetermined intervals.

3. The dynamic microphone of claim 2, wherein the first and second elastic members have a predetermined stiffness dependant upon a ratio of mass of said diaphragm to the mass of said electric acoustic transducer, and a vibration system of said diaphragm having a resonance frequency identical to the resonance frequency of a vibration system sadism of said transducer unit.

4. The dynamic microphone of claim 3, wherein said third elastic member has more flexibility than the second elastic member.

5. The dynamic microphone of claim 2, wherein said third elastic member has more flexibility than the second elastic member.

6. The dynamic microphone of claim 1, wherein the first and second elastic members have a predetermined stiffness dependant upon a ratio of mass of said diaphragm to the mass of said electric acoustic transducer, and a vibration system of said diaphragm having a resonance frequency identical to the resonance frequency of a vibration system of said transducer unit.

7. The dynamic microphone of claim 6, wherein said third elastic member has more flexibility than the second elastic member.

8. The dynamic microphone of claim 1, wherein said third elastic member has more flexibility than the second elastic member.

* * * * *